US009033039B2

(12) United States Patent
Stalder

(10) Patent No.: US 9,033,039 B2
(45) Date of Patent: May 19, 2015

(54) PRODUCER SNORKEL OR INJECTOR TOE-DIP TO ACCELERATE COMMUNICATION BETWEEN SAGD PRODUCER AND INJECTOR

(71) Applicant: ConocoPhillips Company, Houston, TX (US)

(72) Inventor: John L. Stalder, Calgary (CA)

(73) Assignees: ConocoPhillips Canada Resources Corp., Calgary, AB (CA); ConocoPhillips Surmont Partnership, Calgary, AB (CA); Total E&P Canada Ltd., Calgary, AB (CA)

( * ) Notice: Subject to any disclaimer, the term of this patent is extended or adjusted under 35 U.S.C. 154(b) by 54 days.

(21) Appl. No.: 13/774,895

(22) Filed: Feb. 22, 2013

(65) Prior Publication Data

US 2013/0213653 A1 Aug. 22, 2013

Related U.S. Application Data

(60) Provisional application No. 61/601,643, filed on Feb. 22, 2012.

(51) Int. Cl.
*E21B 43/24* (2006.01)

(52) U.S. Cl.
CPC ..... *E21B 43/2406* (2013.01)

(58) Field of Classification Search
CPC ..... E21B 43/24
USPC ..... 166/242.6, 272.3
See application file for complete search history.

(56) References Cited

U.S. PATENT DOCUMENTS

| | | | | |
|---|---|---|---|---|
| 2,776,010 | A * | 1/1957 | Rike | 166/292 |
| 3,120,264 | A * | 2/1964 | Barron | 166/257 |
| 3,346,048 | A * | 10/1967 | Strange et al. | 166/271 |
| 4,344,485 | A * | 8/1982 | Butler | 166/271 |
| 6,119,776 | A * | 9/2000 | Graham et al. | 166/245 |
| 6,158,510 | A | 12/2000 | Bacon | |
| 7,559,375 | B2 | 7/2009 | Dybevik | |
| 2006/0124360 | A1* | 6/2006 | Lee et al. | 175/61 |
| 2008/0217001 | A1 | 9/2008 | Dybevik | |
| 2011/0114388 | A1 | 5/2011 | Lee | |
| 2013/0118737 | A1* | 5/2013 | Schneider et al. | 166/272.3 |

OTHER PUBLICATIONS

Fagan, An Introduction to the Petroleum Industry, Chapter 10 p. 10-3 (1991).*
Halliburton, Foam Cement Delivers Long-Term Zonal Isolation, (2005).*
Alpha Thames Ltd, Dictionary of Oil Industry Terminology, (2004).*
(Continued)

*Primary Examiner* — Angela M DiTrani
*Assistant Examiner* — Avi Skaist
(74) *Attorney, Agent, or Firm* — Boulware & Valoir

(57) ABSTRACT

Methods and systems relating to steam assisted gravity drainage (SAGD) utilizing well pairs that are at least initially in fluid communication through drilled bores toward their toe ends. At least one of a horizontal injection well and horizontal production well of such a well pair includes a hooked length toward toe ends of each other connecting said injection well and said production well. The methods and systems improve SAGD oil production, reduce SAGD start-up time and costs, and improve overall SAGD performance.

11 Claims, 3 Drawing Sheets

(56) References Cited

OTHER PUBLICATIONS

Stalder, "Test of SAGD Flow Distribution Control Liner System, Surmont Field, Alberta, Canada." J. Canadian Petroleum Tech., In Process.

Aiken and Bagci, "A laboratory study of single-well steam-assisted gravity drainage process," J. Petroleum Sci. Eng. 32:23-33 (2001).

Elliot and Kovscek, "A Numerical Analysis of the Single-Well Steam Assisted Gravity Drainage Process (SW-SAGD)".

Mazerov, "Innovative systems enhance ability to achieve selective isolated production in horizontal wells," Drilling Contractor May/June 124-129 (2008).

* cited by examiner

PRODUCER SNORKEL OR INJECTOR TOE-DIP TO ACCELERATE COMMUNICATION BETWEEN SAGD PRODUCER AND INJECTOR

CROSS-REFERENCE TO RELATED APPLICATIONS

This application claims priority to U.S. Provisional Application Ser. No. 61/601,643 filed Feb. 22, 2012, entitled "Producer Snorkel or Injector Toe-Dip To Accelerate Communication Between SAGD Producer and Injector," which is incorporated herein in its entirety.

STATEMENT REGARDING FEDERALLY SPONSORED RESEARCH

None.

FIELD OF THE INVENTION

This invention relates to improving steam assisted gravity drainage ("SAGD") oil production, reducing SAGD start-up time and costs, and improving overall SAGD performance.

BACKGROUND OF THE INVENTION

Enhanced Oil Recovery (abbreviated "EOR") is a term for those techniques for increasing the amount of hydrocarbon that can be extracted from a reservoir. Enhanced oil recovery is also called improved oil recovery or tertiary recovery (as opposed to primary and secondary recovery). Using EOR, 30 to 60 percent or more of the reservoir's original oil can be extracted, compared with 20 to 40 percent using primary and secondary recovery.

SAGD is the most extensively used EOR for in situ development of the million plus centipoises bitumen resources in the McMurray Formation in the Alberta Oil Sands (Butler, 1991).

A typical SAGD process uses two horizontal wells with one above the other, where the upper one is the steam injector and the lower one is the producer, although steam can be injected into both wells in the startup phase.

The injection well is located directly above the production well, usually a short distance (5 to less than 10 meters). When steam is injected continuously into the injection well, it rises in the formation and forms a steam chamber. With continuous steam injection, the steam chamber continues to grow upward and laterally into the surrounding formation. At the interface between steam chamber and cold oil, steam condenses and the heat is transferred to the surrounding oil. The heated oil becomes mobile and drains together with condensed water to the horizontal producer due to gravity segregation within the steam vapor and liquid (heated) bitumen and steam condensate chamber.

The SAGD technique has many advantages when compared to conventional steam injection methods. In conventional steam injection, oil is displaced to a cold area where its viscosity increases and then the mobility is reduced. SAGD employs gravity as the driving force and the heated oil remains warm and movable when flowing toward the production well.

The performance of the SAGD process is determined by many factors including steam chamber development, the length, spacing and location of the two horizontal wells, heat transfer, ability to effect steam trap control to prevent inefficient production of live steam, heat loss and reservoir properties. Many studies have been done to study those elements that are important for the success of SAGD.

As shown in FIG. 1, the standard SAGD well design employs 800 to 1000 meter slotted liners with tubing strings landed near the toe and near the heel in both an injector 101 and a producer 102 to provide two points of flow distribution control in each well, as illustrated in FIG. 1. Steam is injected into both tubing strings at rates controlled so as to place more or less steam at each end of the completion to achieve better overall steam distribution along the horizontal injector completion.

Likewise, the producer is initially gas-lifted through both tubing strings at rates controlled to provide better inflow distribution along the completion. If steam was injected only at the heel of the injector, and water and bitumen were produced only from the heel of the producer, the tendency would be for the steam chamber to develop only near the heel. This would result in limited rates and poor steam chamber development over much of the horizontal completion.

Typically, SAGD wells are drilled about 5 meters apart vertically to achieve steam trap control whereby a gas (steam vapor)-liquid interface is maintained above the producing well to prevent short-circuiting of steam (e.g., premature breakthrough to the producing well) and undue stress on the producing well sand exclusion media. In order to establish initial communication between the wells, it is typical to circulate steam for 3 to 5 months in each well prior to starting SAGD operation. A 3 to 5 month startup time increases the amount of steam, both water and heat, required before production can begin. This added cost may limit projects available for SAGD production.

There is a need to develop more thermally efficient production techniques while increasing the economic viability of the SAGD process.

BRIEF SUMMARY OF THE DISCLOSURE

The present disclosure provides a novel process and system for increasing the thermal efficiency of SAGD operations. By connecting the toe end of the injection well with the toe end of the production well, thermal communication between the two wells is initiated directly. Flow directly from the injection tubing to the production tubing begins when steam is injected, which will significantly reduce the start-up time and cost.

In one embodiment, a single injection tube is provided to the heel end of the injection well liner and steam is pumped through the injection well liner to the connection at the toe end of the injection well to the production well liner, and finally to the heel end of the production liner and the production tube. This results in a reduction in materials, startup time, startup cost, steam oil ratio and improved production, all of which lead to capital investment savings and make SAGD production viable in a larger number of reservoirs.

In one embodiment, SAGD hydrocarbon production well having a horizontal production well is provided in a hydrocarbon reservoir. A horizontal injection well is vertically aligned above the horizontal production well, and the horizontal injector tubing or horizontal production well is provided with a hook length the well, thus fluidly connecting both the injector and production wells.

In some embodiments, more than one hooked length can connect the well pairs at more than one location along the well pairs. In other embodiments, a single hooked length joins the wells pairs at or near the toe ends of the wells.

In another embodiment, a process for steam assisted gravity drainage (SAGD) hydrocarbon production is described including installing a horizontal production well and horizontal injection well in a hydrocarbon reservoir; injecting steam into the injector well; and producing hydrocarbons from said production well, where the horizontal injector well or horizontal production well have a hook at the toe end of the well connecting the injector well and the production well.

Another embodiment provides an SAGD method, comprising:

a horizontal production well having a first toe and comprising a production tubing placed horizontally in a hydrocarbon reservoir; and a horizontal injection well having a second toe and comprising an injection tubing vertically aligned above said horizontal production well, wherein said first toe and said second toe are fluidly connected with a toe connector, thus fluidly connecting said production well and said injection well.

Preferably, the toe connector is also equipped with a flow control device, which allows the fluidic connection to be blocked, but other methods of stopping flow or blocking the fluidic connection can be used, as is known in the art.

Another embodiment is an improved method of SAGD, said method comprising providing horizontal production well below a horizontal injection well, injecting steam into said injection well to mobilize hydrocarbons, and producing said mobilized hydrocarbons from said production well, the improvement comprising fluidly connecting toe ends of said production well and said injection well with a toe connector, wherein said toe connector comprises an optional flow control device.

Preferably, SAGD wells are in hydrocarbon reservoirs of heavy oil, bitumen, tar sands, asphaltenes, or combinations thereof, because SAGD is particularly beneficial for heavier oils. However, the use is not necessarily limited thereby and can be use for other hydrocarbons.

In one embodiment, SAGD hydrocarbon production is shut in for startup for between 1 and 30 days, including 1 day, 2 days, 3 days, 4 days, 5 days, 6 days, 7 days, 8 days, 9 days, 10 days, 11 days, 12 days, 13 days, 14 days, 15 days, 16 days, 17 days, 18 days, 19 days, 20 days, 21 days, 22 days, 23 days, 24 days, 25 days, 26 days, 27 days, 28 days, 29 days and 30 days. In yet another embodiment, steam injection and heavy oil production occur without a startup period.

As used herein, the term "SAGD" includes steam heating and gravity drainage production methods, even where combined with other techniques such as solvent assisted production methods, EM heating methods, cyclic methods and the like.

By "providing" herein we do not mean to imply contemporaneous drilling, and existing wells and liners can be used, if the toe connector can be added thereto to connect the two wells. However, in some cases, well drilling may be required at least at the toe ends to add the toe connector.

By "toe" herein, what is meant is the end or near end of a horizontal well, farthest from the vertical portion. In contrast, the horizontal portion closest the vertical portion is the "heel."

As used herein a "hooked length" is a deviation in a horizontal well path, towards the companion well, such that the two wells will eventually be in fluid communication. The term "toe hook" refers to such as hooked length at or near the toe of the well.

By "toe connector" herein what is meant is a fluidic connection between the toe of the injection well and the toe of the producer well. The shape can vary, depending on how the connection is achieved, as shown in FIG. 3-5.

The use of the word "a" or "an" when used in conjunction with the term "comprising" in the claims or the specification means one or more than one, unless the context dictates otherwise.

The term "about" means the stated value plus or minus the margin of error of measurement or plus or minus 10% if no method of measurement is indicated.

The use of the term "or" in the claims is used to mean "and/or" unless explicitly indicated to refer to alternatives only or if the alternatives are mutually exclusive.

The terms "comprise", "have", "include" and "contain" (and their variants) are open-ended linking verbs and allow the addition of other elements when used in a claim.

The phrase "consisting of" is closed, and excludes all additional elements.

The phrase "consisting essentially of" excludes additional material elements, but allows the inclusions of non-material elements that do not substantially change the nature of the invention, such as instructions for use, adding a solvent or other EOR techniques to the inventive methods, systems and the like.

BRIEF DESCRIPTION OF THE DRAWINGS

A more complete understanding of the present invention and benefits thereof may be acquired by referring to the follow description taken in conjunction with the accompanying drawings in which.

DETAILED DESCRIPTION

Turning now to the detailed description of the preferred arrangement or arrangements of the present disclosure, it should be understood that the features and concepts of this disclosure may be manifested in other arrangements and that the scope of the invention is not limited to the embodiments described or illustrated. The scope of the invention is intended only to be limited by the scope of the claims that follow.

Figure 1:
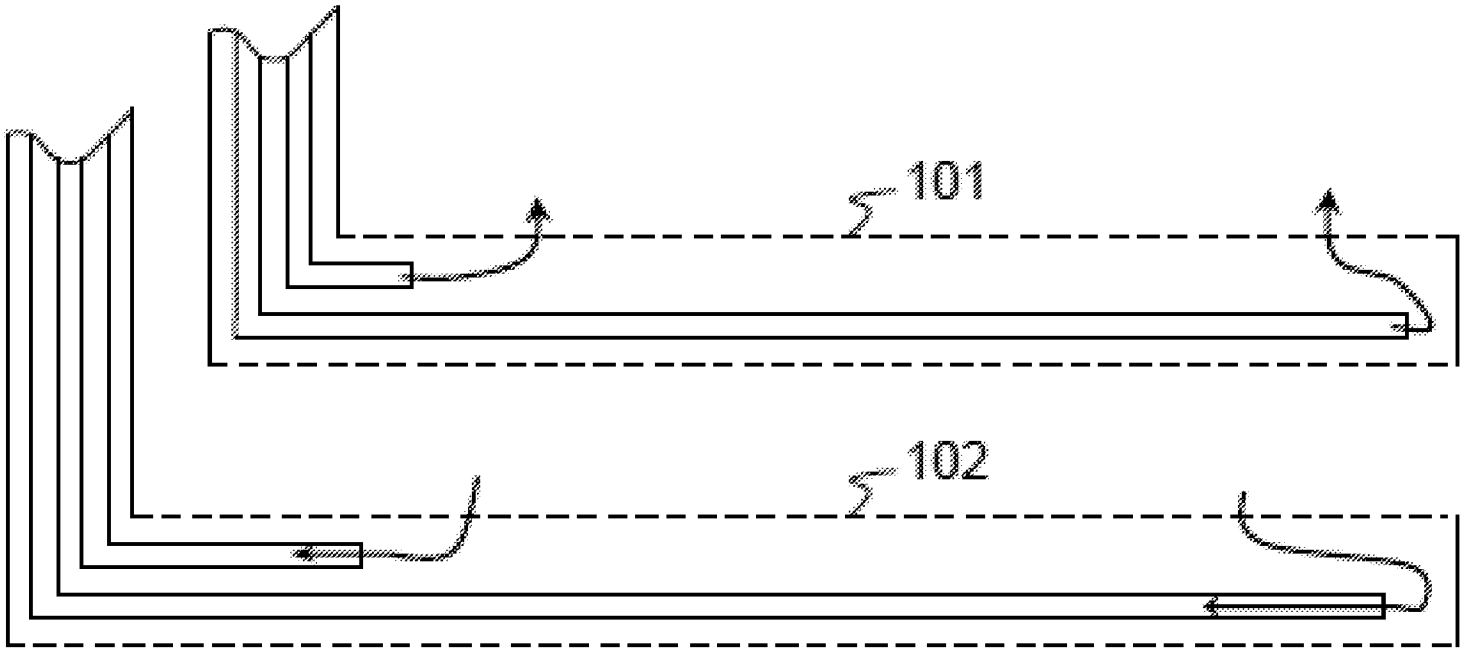
FIG. 1 (PRIOR ART)
FIG. 1: Typical prior art SAGD completion with toe and heel tubing in both the steam injection liner and the producing liner.
Figure 2:
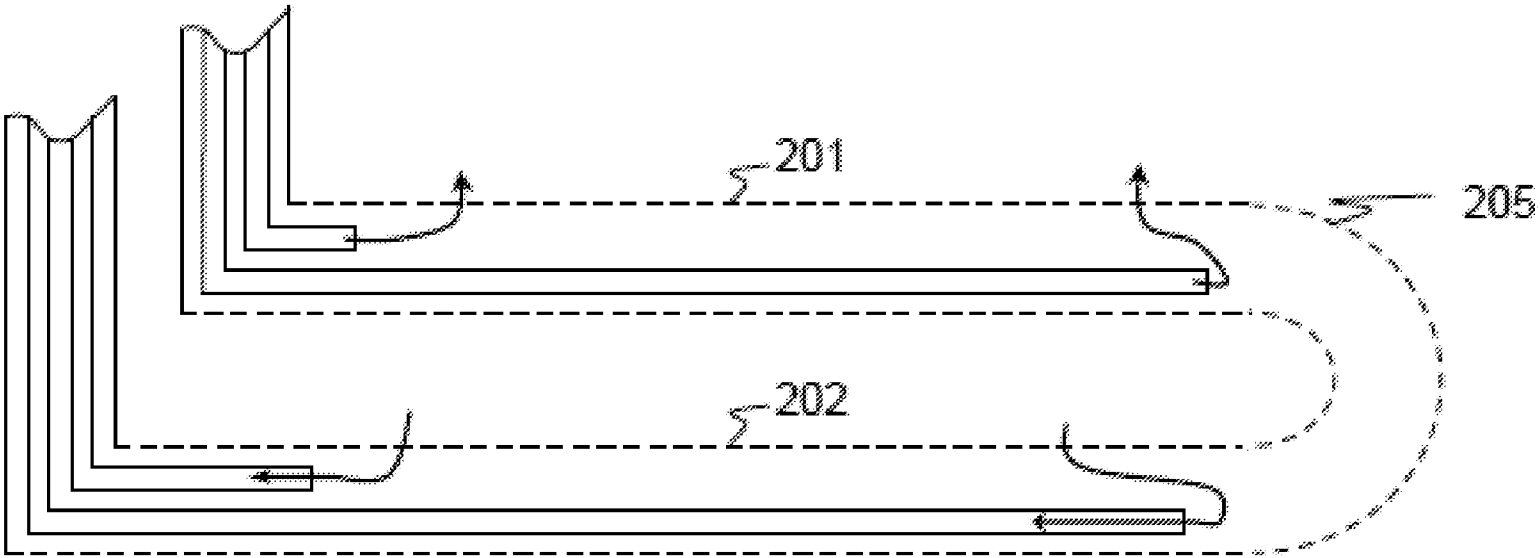
FIG. 2: SAGD completion with a snorkel or toe connector connecting the toe end of the injection liner with the toe end of the production liner, according to one embodiment of the invention.

FIG. 2 illustrates an injection well 201 that injects steam, possibly mixed with solvents or other fluids, and a production well 202 that collects heated crude oil or bitumen that flows out of the formation, along with any water from the condensation of injected steam.

As used herein SAGD refers to such a thermal hydrocarbon production process where two parallel horizontal oil wells are drilled in the formation, one about 0.5 to <10 meters above the other. In some embodiments, the injection and production wells 201, 202 may be between 0.5 and 3, including 1, 1.5, 2, 2.5 or 3 meters apart.

The vertical distance between the injection well and the production well is crucial in the SAGD operations. Typically a magnetic guidance tool (MGT, not shown) is placed inside the production well, which is drilled first, for directional ranging. The MGT moves slightly ahead of the drilling assembly for drilling the injection well, while emitting an electromagnetic field that is picked up by the drilling assembly for the injection well such that an accurate distance between the injection and production wells can be maintained.

A toe hook 205 or 'snorkel' is an intentional connection at the toe end of the injection and production wells 201, 202 that provides a fluid connection directly between the injection well 201 and the production well 202 upon startup. The toe hook 205 may be present in the injection well 201, production well 202 or both injection and production wells 201, 202.

In one embodiment, the toe hook 205 is completed within the hydrocarbon reservoir. In another embodiment, the toe hook 205 is completed beyond the productive reservoir. In yet another embodiment, the toe hook 205 may be an open hole or side lateral extending away from the wellbore liner.

In another embodiment, the toe hook 205 may contain a screen, valve or other device that can be left open, or may provide support for cement, packing or another device for selectively closing the connection between the injection and production wells 201, 202.

As used herein, a hydrocarbon may include any petroleum reservoir including conventional oils, heavy oil, bitumen, tar sands, asphaltenes, and the like. Preferably, SAGD is used with high viscosity oils, tars or bitumens that require heating to liquefy or produce the hydrocarbon. In some instances, SAGD may be used with other hydrocarbon reservoirs as an enhanced oil recovery technique or to produce additional hydrocarbons from a reservoir. In one embodiment, SAGD is used to produce bitumen from a subterranean reservoir.

As discussed above, standard SAGD is a thermal in-situ heavy oil recovery process. The procedure is applied to at least a well pair, but multiple wells are often used. The well pairs are first drilled vertically, then slowly angled, typically 9°/100 feet until finally drilled horizontally, parallel and vertically aligned with each other. The length of and vertical separation between the injection and production wells are on the order of 1 kilometer and 5 meters, respectively.

The upper well (or wells) is known as the "injection well" and the lower well (or wells) is known as the "production well". The process herein begins by circulating steam in both wells, preferably through the hooked length toe connector discussed here, so that the bitumen between the well pair is more efficiently heated enough to flow to the lower production well. The steam chamber heats and drains more and more bitumen until it has overtaken the oil-bearing pores between the well pair.

Steam circulation in the production well is then stopped and steam injected into the upper injection well only, so that the bitumen located above the injection well can also be heated and viscosity reduced and eventually produced through the production well. Specifically, the cone shaped steam chamber, anchored at the production well, now begins to develop upwards from the injection well. As new bitumen surfaces are heated, the oil lowers in viscosity and flows downward along the steam chamber boundary into the production well by way of gravity.

The following is a discussion of certain embodiments of the invention. Each is provided by way of explanation of the invention, one of many embodiments of the invention, and should not be read to limit, or define, the scope of the invention.

Production Toe Connected to Injection Well

Figures 3, 4, 5:
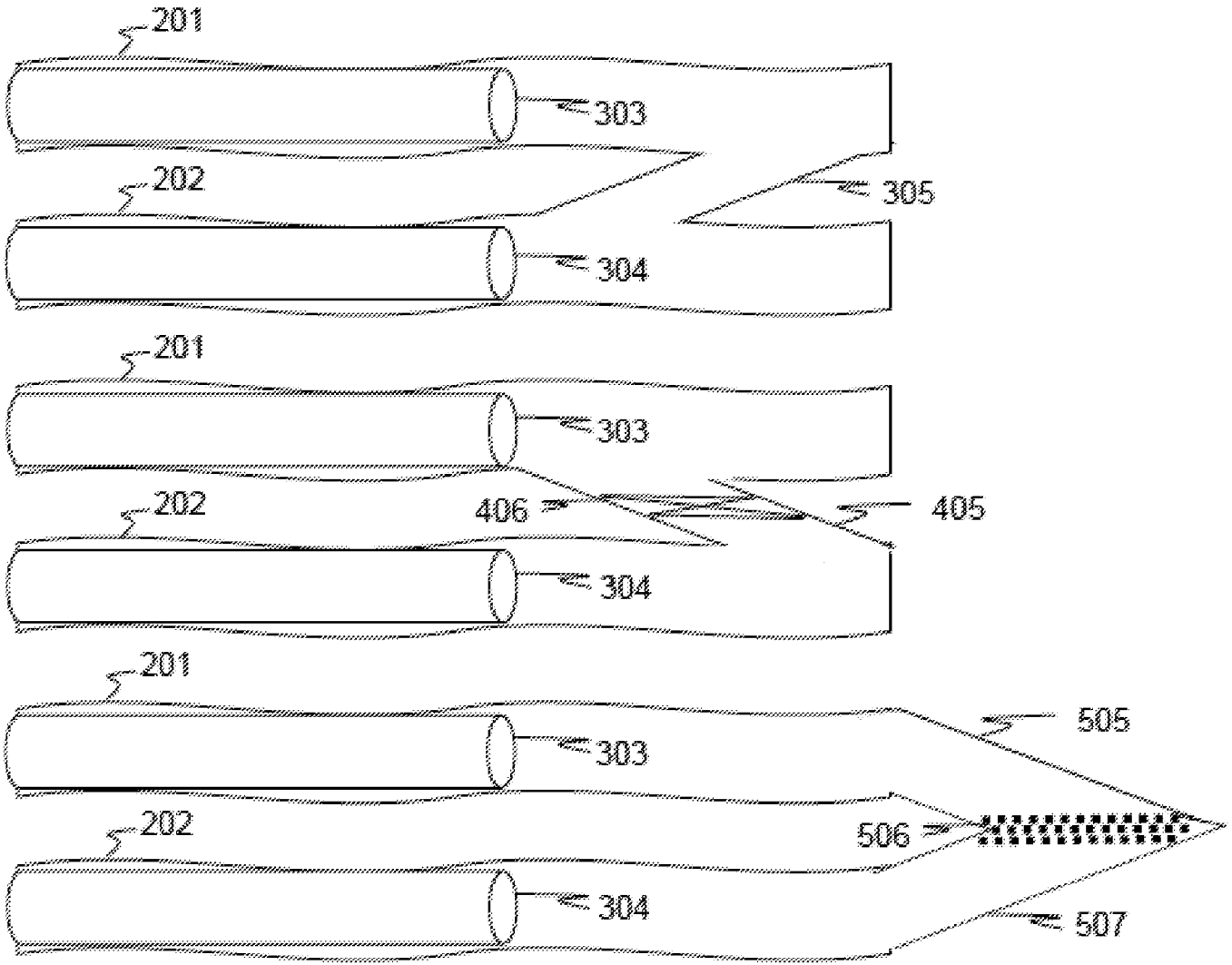
FIG. 3: A SAGD configuration with production toe hooked and connected to the injection well, according to one embodiment of the invention.
FIG. 4: A SAGD configuration with injection toe hooked and connected to the production well, according to one embodiment of the invention.
FIG. 5: A SAGD configuration with the injection and production toe ends both hooked and connected together, according to one embodiment of the invention.

FIG. 3 shows the horizontal production well 202 drilled using standard drilling techniques. A toe tip 305 of the production well 202 is deviated upward forming a communication channel, like a snorkel.

The exact shape of the communication channel is not limited, as long as thermal communication through the steam can be effectively carried out and the drilling cost is kept to the minimum. The drilling assembly is pulled back to the kickoff point of the snorkel and the horizontal section is extended to the design length of the completion. The hole is cleaned as normal and a producer liner 304 is run in the horizontal section past the snorkel (not into the snorkel).

Then, the injection well 201 is drilled above the production well 202 as normal with the intention that the tip of the injection well 201 will intersect the snorkel or pass very close to the snorkel. Then, an injector liner 303 is run in the injection well 201. Although the injection well 201 may be drilled first, this is not standard practice and has many limitations. For example, it is difficult to maintain the vertical distance if the injection well 201 is drilled first.

In one embodiment, the toe tip 305 of the production well 202 is deviated upward approximately 7 vertical meters over less than 50 m of horizontal distance. Tighter turn radii may be used but are not required.

Alternatively, the toe tip 305 of the production well 202 may be slowly raised beyond the production zone and the injection well 201 extended to intersect with the production well 202. The slope of the hook or snorkel may be anywhere from 7:50 as described above or 1:10, 1:7, 1:5, 1:4 or 1:3 vertical incline for each linear meter. It is to be noted that the slope of the snorkel should not affect the efficiency of thermal communication between the injection and production wells, but rather a practical result of choosing different drilling parameters.

Injection Toe Connected to Production Well

FIG. 4 illustrates the production well 202 drilled and completed first, near the bottom of the reservoir. Next, the injection well 201 is drilled above and parallel to the production well 202 as discussed above, but a toe tip 405 of the injection well 201 is "dipped" downward to connect with the production well 202 without damaging the producer liner 304. The injector liner 303 may now be run in the injection well 201.

In one embodiment, the injector liner 303 may employ blank pipe (not slotted) for the toe tip 405 portion except for an open screen portion at the end close to the production well 202. This blank section may be plugged later by a ball, plug or other suitable means when appropriate.

The optional blank liner may also incorporate other devices including a valve, screen, shut-off mechanism or flow control device 406. Although the injection well 201 may be drilled first, this is not standard practice and has many limitations. It is easier to determine if the hook is progressing correctly if the production well 202 is drilled first and the injection well 201 is dropped close to the production well 202.

Hooking Both the Injection and Production Well

FIG. 5 shows hooking both the injection and production wells 201, 202 with either the injection or production well drilled first. Typically, the production well 202 is drilled first and the injection well 201 drilled over and parallel to the production well 202. This accommodates curves and undulation in the formation underburden. The production well 202 is drilled to length and hooked slightly upward at the end 507 of the well to a fixed location. The injection well 201 is drilled to a fixed distance over the production well 202.

Once the injection well 201 is drilled to length it is hooked at the end 505 of the injection well 201 such that the injection and production wells meet at a fixed location within the formation.

The point where the injection and production wells 201, 202 meet may be treated with a flowable proppant 506, screen, or liners such that once the steam chamber is sufficiently formed, the toe of the well may optionally be sealed or closed. This optional procedure is not required because the steam trap will typically rise above the production well 202.

SAGD injection, production or both injection and production wells may be hooked toward one or the other to connect the wells at the toe end of the well. Whatever drilling method employed, the resulting toes are now fluidly connected via a "toe connector."

The toe connector may be added during an initial completion, during well work-over, or when the initial wells are extended. For some wells, it may help to improve initial startup or reduce startup time to zero. Initial production with a toe-to-toe connection can begin immediately because breakthrough is not required.

Steam may be injected through either well if startup is required.

In one embodiment, steam is injected through the injection well and returned through the production well. Because this is the same configuration used during standard SAGD production, no additional equipment, start-up equipment or changes to configuration are required. Because startup time is reduced or entirely removed, costs and steam/water to oil ratios are reduced to a minimum. This is extremely cost effective and conserves resources, useful when water and other materials are scarce or difficult to bring to the site.

Although the systems and processes described herein have been described in detail, it should be understood that various changes, substitutions, and alterations can be made without departing from the spirit and scope of the invention as defined by the following claims. Those skilled in the art may be able to study the preferred embodiments and identify other ways to practice the invention that are not exactly as described herein. It is the intent of the inventors that variations and equivalents of the invention are within the scope of the claims while the description, abstract and drawings are not to be used to limit the scope of the invention. The invention is specifically intended to be as broad as the claims below and their equivalents.

All of the references cited herein are expressly incorporated by reference. The discussion of any reference is not an admission that it is prior art to the present invention, especially any reference that may have a publication data after the priority date of this application. Incorporated references are listed again here for convenience:

U.S. Pat. No. 6,158,510, Bacon, et al., "Steam distribution and production of hydrocarbons in a horizontal well." ExxonMobil Upstream Res Co., (2000).

U.S. Pat. No. 6,119,776, Graham, et al., "Methods of stimulating and producing multiple stratified reservoirs," Halliburton, (2000).

U.S. Pat. No. 7,559,375, US20080217001, Dybevik, et al., "Flow control device for choking inflowing fluids in a well," Reslink AS, (2008).

US2010126727, Vinegar, et al., "In Situ Recovery From A Hydrocarbon Containing Formation," Shell (2010).

US20110114388, Lee, et al., "Methods and apparatus for drilling, completing and configuring U-tube boreholes," Halliburton Energy Services, (2011).

Akin and Bagci, "A laboratory study of single-well steam-assisted gravity drainage process," J. Petroleum Sci. Eng. 32:23-33 (2001).

Butler, "Thermal Recovery of Oil & Bitumen", Chapter 7: "Steam-Assisted Gravity Drainage", Prentice Hall, (1991).

Elliot and Kovscek, "A Numerical Analysis of the Single-Well Steam Assisted Gravity Drainage Process (SW-SAGD)"

Pao, Richard H. F., "Fluid Mechanics", pp. 286-290. John Wiley & Sons, 1965.

Stalder, "Test of SAGD Flow Distribution Control Liner System, Surmont Field, Alberta, Canada." J. Canadian Petroleum Tech., IN PROCESS.

What is claimed is:

1. A process for steam assisted gravity drainage (SAGD) hydrocarbon production, comprising:

installing a horizontal production well comprising a production tubing and a horizontal injection well comprising an injector tubing in a hydrocarbon reservoir, wherein at least one of said wells comprise a hooked length toward the other of said wells and thus fluidly connecting said horizontal injection well and said horizontal production well, wherein said hooked length is a solid wall blank liner with a flow control device for selectively blocking fluid communication between the production and injection wells through the hooked length;

injecting steam into said injector tubing; and producing hydrocarbons from said production tubing.

2. The process of claim 1, further comprising closing fluid communication between the injection and production wells through the hooked length.

3. The process of claim 1, further comprising circulating steam in the production and injection wells for startup prior to closing fluid communication between the injection and production wells through the hooked length.

4. The process of claim 1, wherein the hooked length is at a terminus of at least one of the injection and production wells.

5. The process of claim 1, wherein the hooked length is at a terminus of both the injection and production wells.

6. The process of claim 1, wherein said hydrocarbons comprise heavy oil, bitumen, tar sands petroleum, asphaltenes, and combinations thereof.

7. The process of claim 1, wherein said steam injection and heavy oil production occur without a startup period.

8. The process of claim 1, wherein said SAGD hydrocarbon production is shut in for startup for between 1 and 30 days.

9. A steam assisted gravity drainage (SAGD) hydrocarbon production system, comprising:

a horizontal production well having a first toe and comprising a production tubing placed horizontally in a hydrocarbon reservoir; and a horizontal injection well having a second toe and comprising an injection tubing vertically aligned above said horizontal production well, wherein said first toe and said second toe are fluidly connected with a toe connector, thus fluidly connecting said production well and said injection well, and wherein said toe connector is a solid wall blank liner with a flow control device for selective blocking fluid communication between the production and injection wells via the toe connector.

10. An improved method of SAGD, said method comprising providing a horizontal production well below a horizontal injection well, injecting steam into said injection well to mobilize hydrocarbons, and producing said mobilized hydrocarbons from said production well, the improvement comprising fluidly connecting toe ends of said production well and said injection well with a toe connector, wherein said toe connector is a solid wall blank liner and comprises a flow control device.

11. A process for steam assisted gravity drainage (SAGD) hydrocarbon production, comprising:

installing a horizontal production well comprising a production tubing and a horizontal injection well comprising an injector tubing in a hydrocarbon reservoir, wherein at least one of said wells comprise a hooked length toward the other of said wells and thus fluidly connecting said horizontal injection well and said horizontal production well, wherein said hooked length is a solid wall blank liner with a flow control device for selectively blocking fluid communication between the production and injection wells through the hooked length;

circulating steam in both the production and injection wells through said hooked length during a startup phase;

closing fluid communication between the injection and production wells through the hooked length;

injecting steam into said injector tubing; and producing hydrocarbons from said production tubing.

* * * * *